US007269867B2

(12) United States Patent
Karlstedt

(10) Patent No.: US 7,269,867 B2
(45) Date of Patent: Sep. 18, 2007

(54) COMBINATION TOOL

(76) Inventor: Magnus H. Karlstedt, 1429 Pulaski St., Port Charlotte, FL (US) 33952

( * ) Notice: Subject to any disclaimer, the term of this patent is extended or adjusted under 35 U.S.C. 154(b) by 0 days.

(21) Appl. No.: 10/958,491

(22) Filed: Oct. 5, 2004

(65) Prior Publication Data

US 2006/0070186 A1 Apr. 6, 2006

(51) Int. Cl.
*B26B 11/00* (2006.01)
*B25F 1/00* (2006.01)

(52) U.S. Cl. ..... 7/105; 7/163; 7/164

(58) Field of Classification Search ..... 7/158, 7/163, 164, 105; 30/136, 167.2, 172, 295
See application file for complete search history.

(56) References Cited

U.S. PATENT DOCUMENTS 494,921 A * 4/1893 Hayward ..... 7/105
1,052,695 A * 2/1913 Sheldon ..... 30/112
1,217,286 A * 2/1917 Dewees ..... 7/150
1,754,543 A * 4/1930 Callum ..... 30/295
3,760,438 A * 9/1973 White ..... 7/106
3,842,458 A * 10/1974 Bauer ..... 7/134
5,251,352 A * 10/1993 Cullison ..... 7/105
5,979,058 A * 11/1999 Henke ..... 30/143
6,220,133 B1 * 4/2001 Gosselin ..... 83/13
6,421,860 B1 * 7/2002 Abbott ..... 7/105
2004/0020056 A1 * 2/2004 McFadden et al. ..... 30/123

* cited by examiner

*Primary Examiner*—Debra S Meislin

(57) ABSTRACT

The invention is essentially a tool device which is a combination of components, features and functions, including knife, chisel, scrapper, ruler, depth gage, and straight edge, housed in one easily handled and transported unit.

1 Claim, 2 Drawing Sheets

COMBINATION TOOL

CROSS-REFERENCE TO RELATED APPLICATIONS

Not Applicable.

STATEMENT REGARDING FEDERALLY SPONSORED RESEARCH OR DEVELOPMENT

Not Applicable

REFERNCE TO SEQUENTIAL LISTING, A TABLE OF A COMPUTER PROGRAM LISTING COMPAC DISK APPENDIX

Not Applicable

BACKGROUND OF INVENTION

The use of specific purpose tools by craftsmen, contractors, handymen and hobbyists, particularly in the building trades and in home projects, that is "the right tool for the right job", results in the accomplishment of a particular construction related project being completed more quickly and more proficiently than would otherwise be possible. However, the use of multiple, separate tools increases the cost to the user of assembling the range of tools needed, and furthermore, increases the burden and inconvenience of the user in having to carry with him, often to inconvenient locations at a construction site, those multiple tools. The present invention combines into one convenient tool the capabilities of several otherwise separate tools, resulting in substantially less burden for the user by virtue of avoiding the otherwise need to carry multiple tools, while simultaneously enabling the cost of that combined tool to be lower than the cumulative cost of the alternative of the user having to purchase multiple separate tools to accomplish the same ultimate objective.

BRIEF SUMMARY OF THE INVENTION

The invention is essentially a tool device which is a combination of features, including knife, chisel, ruler, depth gage, and straight edge, housed in one easily handled and transported unit.

DETAILED DESCRIPTION OF THE INVENTION

This invention is essentially a compound tool device which, in it's preferred embodiment, is a combination of features, including knife, chisel/scrapper, ruler, depth gage, and straight edge, housed in one easily handled and transported unit, the preferred embodiment of which is depicted in FIGS. 1 through 5 hereof.

Figure 1:
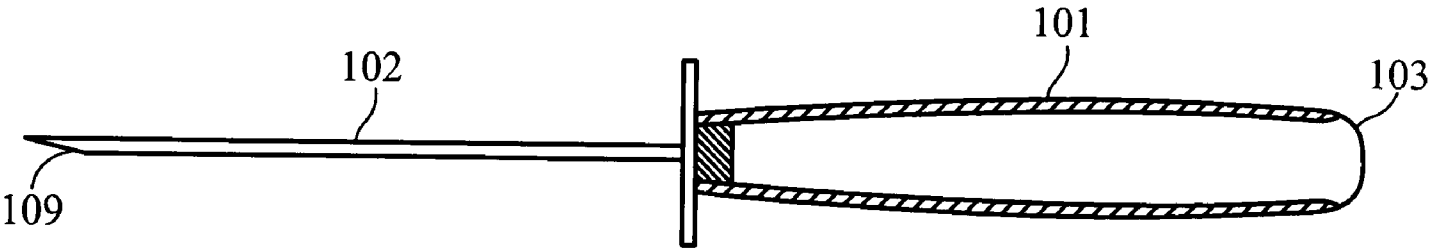
FIG. 1 top view of the combination tool device.
Figure 2:
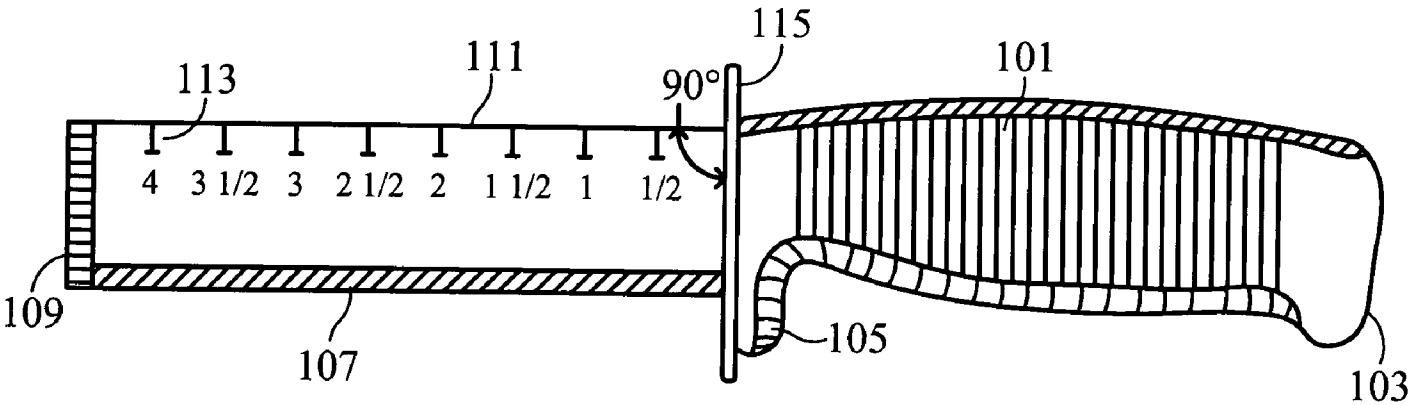
FIG. 2 side view of the combination tool device, with the handle on the right side.
Figure 3:
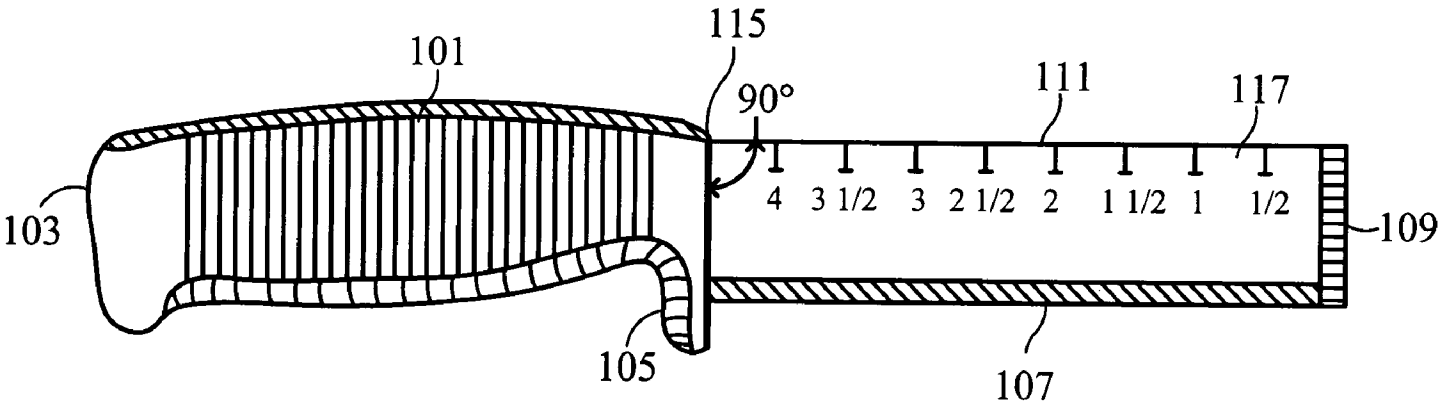
FIG. 3 side view of the combination tool device, with the handle on the left side, being the reverse side from that depicted in FIG. 2.
Figure 5:
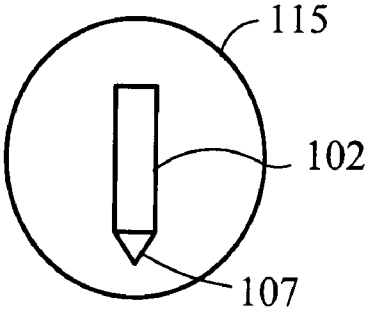
FIG. 5 end view, from the chisel edge side of the combined tool device.
Figure 4:
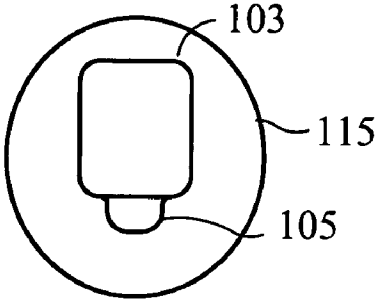
FIG. 4 end view, from the handle side of the combined tool device.

The invention, in the preferred embodiment, encompasses the following combined components, features and functions:

a handle (101), as depicted in FIG. 1, with which the user holds the compound tool device of which the handle is itself a component;

a multi-faceted attachment (102), as identified in FIG. 1 and particularly depicted in FIG. 2 and FIG. 3, which is affixed to or extended from the said handle (101);

a chisel/scrapper edge (109), as depicted in FIG. 1, FIG. 2, and FIG. 3, on the edge of the said attachment (102) which is positioned furthest from the handle (101), with which said chisel/scrapper edge the user of the tool can penetrate the surface of materials contacted by the said chisel/scrapper edge and remove portions of the said material;

an impact-receiving surface (103), as depicted in FIG. 1, FIG. 2 and FIG. 3, at which impact receiving surface the user of the tool can dynamically contact the end of the compound tool device with a hammer, or similar impact delivery tool, to thereby apply pressure longitudinally through the compound tool device to the chisel/scrapper edge (109), causing force to be applied to the said chisel/scrapper edge (109), which when in contact with a material which is not a art of the compound tool device, will cause the chisel to penetrate into the said material;

a knife edge surface (107) along essentially the length of one side edge of the said attachment (102) with which the user can cut various materials as he would with a simple knife;

a convex safety edge surface extension (105) on the said handle (101) at the point of joinder of the said handle (101) with the said attachment (102) to prevent the hand of the user from inadvertently slipping along the handle (101) in the direction of the attachment (102) toward the knife blade (107) and the chisel blade (109);

a straight and level edge surface (111), as depicted in FIG. 2 and FIG. 3, along the non-knife blade edge and non-chisel/scrapper edge of the said attachment (102), and on the opposite side of the knife blade edge (107) of the said attachment (102), which said a straight and level edge surface (111) is perpendicular to the said attachment (102) side of the surface of the flat surface plate (115) located between the said handle (101) and the said attachment (102) at the point of joinder of the said handle and said attachment, by virtue of which perpendicular relationship between the said flat surface plate (115) and the straight and level edge surface (111) the compound tool device can be used as a straight edge to thereby enable the drawing and marking of lines which are exactly perpendicular to each other;

graduated precisely measured markings (113), as depicted in FIG. 2, along the non-knife blade edge, and non-chisel/scrapper edge (111) of the said attachment (102), and on the opposite side of the knife blade edge (107) of the said attachment (102), with said markings being in either inches or metric length measurements, with the zero length measurement being and beginning at the point of joinder of the said handle (101) with the said attachment (102), on the said attachment (102) side of the surface of the flat surface plate (115) located between the said handle (101) and the said attachment (102) at the point of joinder of the said handle and said attachment, with said length measurement markings increasing in the direction from the said attachment (102) side of the surface of the flat surface plate (115) and toward the chisel edge (109) of the said attachment (102), by virtue of which markings (113) the length of an item, or the distance between two items, can be easily and accurately be measured by the user of the said compound tool; and graduated precisely measured markings (117), as depicted in FIG. 3, along the non-knife blade edge and non-chisel/scrapper edge (111) of the said attachment (102), and on the opposite side of the knife blade edge (107) of the said attachment (102), with said markings being in either inches or metric length measurements, with the zero length measurement being and beginning at the chisel/scrapper edge (109) of the said attachment (102), with said length measurement markings increasing in the direction from the said chisel/scrapper edge (109) toward the said attachment (102) side of the surface of the flat surface plate (115), by virtue of which markings (117) the length of an item, or the distance between two items, or the depth of an opening, including the depth of a void created by the chisel/scrapper edge (109), can be easily and accurately be measured by the user of the said compound tool.

While the invention need include some of the aforesaid features, it need not necessarily include all of the said features in the same tool.

It is contemplated that the inventive concepts herein described may be variously otherwise embodied and it is intended that the appended claims be construed to include and encompass alternate embodiments of the invention except only insofar as limited by prior art.

The invention claimed is:

1. The invention claimed is a compound tool device comprising:

a handle;

an attachment to the said handle, with the axis of the longest dimension of the handle being aligned with the axis of the longest dimension of the said attachment;

a safety edge surface extension on the said handle, positioned at the point of joinder of the said handle and the said attachment;

an impact absorbing end of the said handle, positioned at the edge of the said handle furthest distant from the point of joinder of the said handle with the said attachment;

a chisel and scrapper edge surface at the edge of the said attachment which is most distant from the point of joinder of the said handle and the said attachment;

a cutting knife edge surface along one longitudinal edge of the said attachment positioned from and between the point of joinder of the said handle and the said attachment to the beginning of the said chisel/scrapper edge of the said attachment;

a flat surface plate positioned between the said handle and the said attachment, and located at the point of joinder of the said handle and the said attachment, the axis of the said flat surface being perpendicular to the longitudinal axis of the longest dimension of the said handle and the said attachment;

a straight and level edge surface on the said attachment, positioned along the length of the said attachment between the said chisel and scrapper edge and running to the said flat surface plate, and located opposite to the said cutting knife edge surface, which straight and level edge surface is perpendicular to the said flat surface plate;

graduated precisely measured markings affixed and positioned along the length of the said straight and level edge surface on the said attachment, and located opposite to the said cutting knife edge surface, with the zero measured marking beginning at the point of connection between the said flat surface plate and the said attachment, and increasing in measurement toward and in the direction of the chisel and scrapper edge of the said attachment; and graduated precisely measured markings affixed and positioned along the length of the said straight and level edge surface on the said attachment, and located opposite to the said cutting knife edge surface, with the zero measured marking beginning at the chisel and scrapper edge of the said attachment and increasing in measurement toward and in the direction of the point of connection between the said flat surface plate and the said attachment, which said measured markings are on the opposite side of the said attachment from the measured markings referred to in the immediately preceding element hereof.

* * * * *